United States Patent [19]

Hiyoshi et al.

[11] 4,083,283

[45] Apr. 11, 1978

[54] ELECTRONIC MUSICAL INSTRUMENT HAVING LEGATO EFFECT

[75] Inventors: Teruo Hiyoshi; Akira Nakada; Shigeru Yamada, all of Hamamatsu; Kiyoshi Ichikawa, Hamakita; Sigeki Isii, Hamamatsu, all of Japan

[73] Assignee: Nippon Gakki Seizo Kabushiki Kaisha, Hamamatsu, Japan

[21] Appl. No.: 723,758

[22] Filed: Sep. 16, 1976

[30] Foreign Application Priority Data

Sep. 17, 1975 Japan ..... 50-113037

[51] Int. Cl.[2] ..... G10H 1/02

[52] U.S. Cl. ..... 84/1.24; 84/1.26

[58] Field of Search ..... 84/1.01, 1.03, 1.13, 84/1.24, 1.26

[56] References Cited

U.S. PATENT DOCUMENTS

| | | | |
|---|---|---|---|
| 3,610,806 | 10/1971 | Deutsch | 84/1.26 |
| 3,898,905 | 8/1975 | Schreier | 84/1.01 |
| 3,910,150 | 10/1975 | Deutsch et al. | 84/1.03 |
| 3,924,505 | 12/1975 | Schrecongost | 84/1.01 |
| 3,971,284 | 7/1976 | Schreier | 84/1.26 |
| 4,014,238 | 3/1977 | Southard | 84/1.13 |

*Primary Examiner*—B. Dobeck
*Assistant Examiner*—Vit W. Miska
*Attorney, Agent, or Firm*—Spensley, Horn & Lubitz

[57] ABSTRACT

An electronic musical instrument is of a type wherein an envelope to be imparted to a musical tone is stored in a memory as its sampled values and sequentially read out to constitute an envelope shape. A key depression causes the read-out of the memory.

The instrument is improved to provide a rich sound effect of legato performance by successively and smoothly shifting the tone of the former key to that of the latter key while maintaining a predetermined constant tone volume. This legato effect can be carried out by successively maintaining the sustain level of the musical tone envelope from the tone of the former key shifted to the latter key. The musical tone envelope is read from the envelope memory by an address which is shifted by a clock pulse. After the key has been depressed, the address continues to be shifted by the clock pulse until it has reached a predetermined value, whereupon the supply of the clock pulse is prohibited to cause the envelope memory to produce a sustain level corresponding to the address. Thereafter, this address is held to maintain the sustain level of tones of subsequently depressed keys regardless of whether the initially depressed key ash been released or not, or whether the subsequently depressed keys are being depressed or have been released. An embodiment in which the legato effect is produced with respect to a pedal keyboard is described.

6 Claims, 18 Drawing Figures

ELECTRONIC MUSICAL INSTRUMENT HAVING LEGATO EFFECT

BACKGROUND OF THE INVENTION

1. Field of the invention

This invention relates to an electronic musical instrument which has a legato effect in playing a pedal keyboard and, more particularly, to an electronic musical instrument capable of prohibiting to read out the amplitude envelope of the decay portion of single note played thereon stored in an envelope memory for defining a timing loudness change of a musical tone as desired merely as to the musical note of the pedal keyboard.

2. Description of the Prior Art

The pedal keyboard is actuated by a foot of a player in an electronic musical instrument such as an electronic organ, electric pianos, etc. in case of bass accompaniment for the musical played thereby. The pedal keyboard is generally operated by one foot of the player, and a knee lever or pedal for an expression effect is used by another knee or foot. Therefore, if the player of the electronic organ operates to shift from one to another key in a pedal keyboard performance, he must always depress the next key after he released the former key with the result that the attenuated sound of the former key is present before the rise portion of the musical tone when the key is depressed. Consequently, it was heretofore very difficult to provide a legato effect in the performance of the electronic organ with the pedal keyboard.

The term "legato effect" is used throughout the specification and claims in a generic sense to means that the sound of the former key is successively and smoothly shifted to that of the latter key while maintaining a predetermined constant sound volume, as was known heretofore.

SUMMARY OF THE INVENTION

In general, an envelope of a musical tone signal in an electronic musical instrument is composed of an attack portion forming the shape of the rise portion immediately after depression of a key, a sustain portion continuing a constant level after the attack portion, and a decay portion forming that of the fall portion after releasing of the key. According to the present invention, the legato effect for successively and smoothly maintaining the sustain level from the sound of the former key shifted to the latter key is provided by the electronic musical instrument which comprises an envelope memory for storing an attack waveform and a decay waveform, an envelope counter for reading the envelope waveform stored in the envelope memory, a clock pulse generator for generating attack clock pulses and decay clock pulses, means for prohibiting the supply of the clock pulses from the clock pulse generator to the envelope counter regardless of depression and release of the key depressed thereby prohibiting the reading of the envelope of the decay portion of the musical tone signal from the envelope memory as desired only relative to the sound of the pedal board.

It is an object of the present invention to provide an electronic musical instrument capable of legato performance with the pedal keyboard thereof.

It is another object of the present invention to provide an electronic musical instrument capable of conducting a good bass accompaniment.

It is a further object of the present invention to provide an electronic musical instrument capable of prohibiting the envelope of a decay portion of a musical tone even upon release of the former key shifted to the latter key.

It is still another object of the invention to provide an electronic musical instrument capable of also prohibiting the supply of the clock pulses from the clock pulse generator to the envelope counter regardless of depression and release of the key even after shifted to the next key depressed.

These and other objects and features of the invention will become apparent in conjunction with the following description and drawings which are included for illustration purposes only.

BRIEF DESCRIPTION OF THE DRAWINGS

FIG. 1(*b*) is a graphic diagram similar to FIG. 1, but showing that according to the present invention for the purpose of describing the legato effect of the pedal keyboard;

DESCRIPTION OF THE PREFERRED EMBODIMENTS

Figure 1:
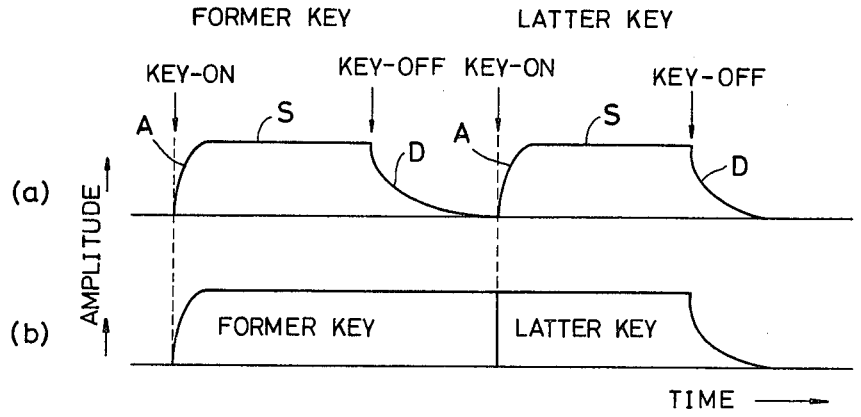
FIG. 1(*a*) is a graphic diagram illustrating the general musical tone characteristic of an envelope waveform.

Referring to FIG. 1(*a*) which shows the general musical tone characteristic of the envelope wave shape in an electronic musical instrument, the amplitude envelope of the musical tone is consisting of an attack portion A forming the rise portion of the sound obtained immediately after the depression of a key, a sustain portion S maintaining a predetermined level after the attack portion A, and a decay portion D gradually attenuating the sound from the sustain level after the release of the first key. In case where the legato effect is not necessary in the electronic musical instrument such as an electronic organ, when the second key is depressed after the first key is released, the envelopes of the respective musical tones are, in turn, completed in order of attack portion A, sustain portion S and decay portion D.

As shown in FIG. 1(*b*), which depicts the waveform of the envelope of the musical tone characteristic in accordance with the present invention, in order to provide a legato effect between the first and the second keys depressed sequentially, the instrument circuit prohibits the envelope of the decay portion D of the musical tone even if the first key is already released, but retains the sustain level as it is so that the sustain level is not rest, but successively maintained even though the second key is depressed. Thus, the electronic musical instrument of the present invention achieves the legato effect for varying only the pitch corresponding from the first to the second key while maintaining the sound volume at a predetermined constant level.

Figure 2:
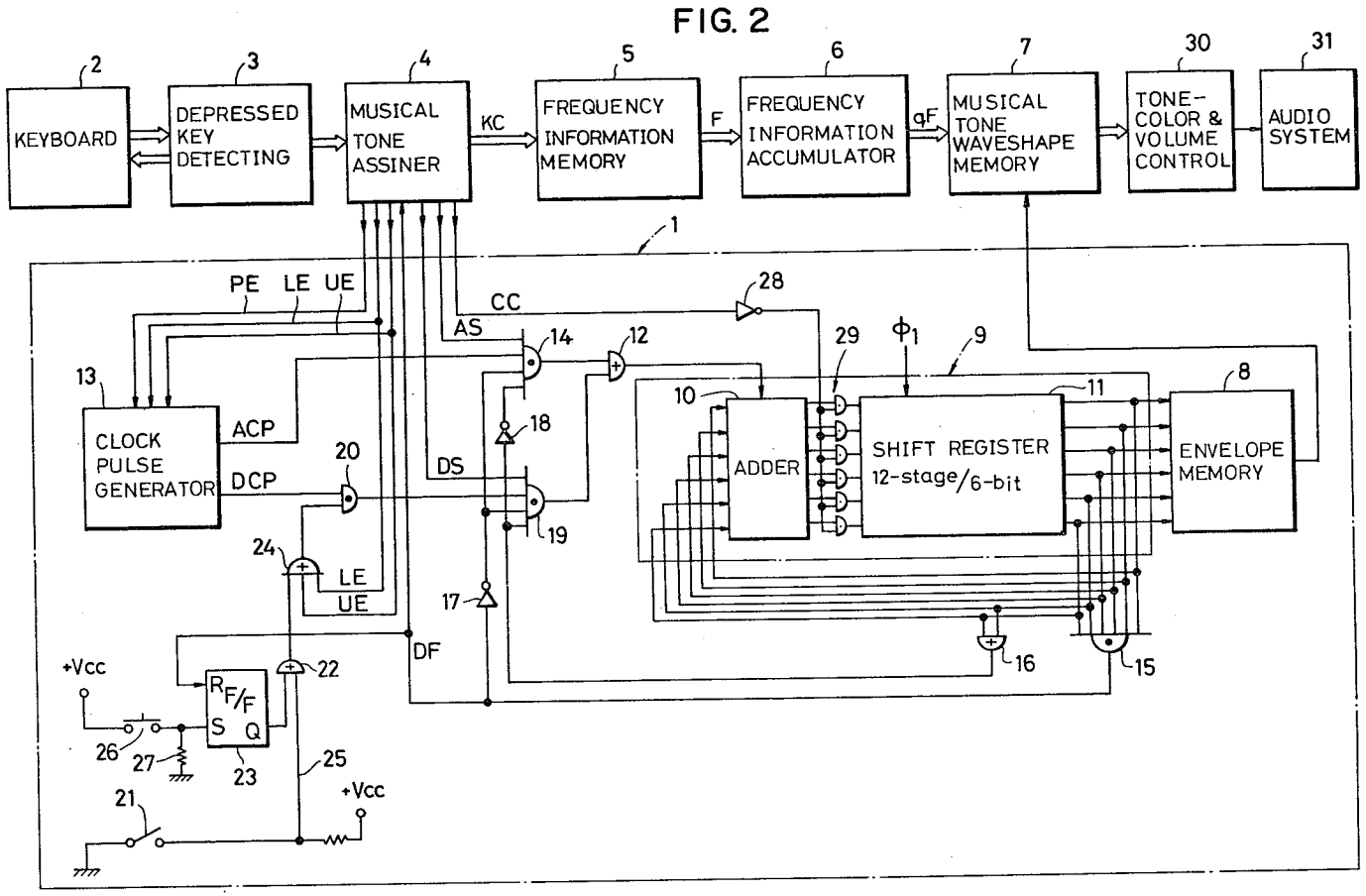
FIG. 2 is a block diagram of one embodiment of the electronic musical instrument constructed according to the present invention.

In FIG. 2, which illustrates a block diagram of one preferred embodiment of the electronic musical instrument circuit arranged according to the present invention, the overall arrangement of the electronic musical instrument including an envelope generating circuit 1 as the feature of the present invention will now be hereinafter described in greater detail.

A keyboard 2 has key switches (not shown) corresponding to respective keys (not shown) in the conventional manner.

A depressed key detecting circuit 3 detects the making or breaking operation of the key switches corresponding to the respective keys (not shown) located at the keyboard 2 to produce an output signal distinctly indicative of the depressed key.

A musical tone assigning circuit or key assigner 4 receives the signal distinctly representing the key depressed from the depressed key detecting circuit 3 and thereby serves the function of assigning the musical tone or note of the key represented by the signal from the detecting circuit 3 to any of the channels corresponding to a maximum available number of musical tones to be simultaneously reproduced such as, for example 12 channels in this embodiment. The key assigner 4 comprises key code memory units corresponding to the respective channels which are capable of storing key codes KC indicative of the keys in the respective memory units corresponding to the channels assigned with certain musical tones of the keys and successively outputting the key codes KC stored in the respective channels in a time-sharing manner. Accordingly, if plural keys are simultaneously depressed in the keyboard 2, the musical tones of the respective keys thus depressed are assigned to separate channels, respectively and the key codes KC representing the key thus assigned to the channels are stored in the memory units corresponding to the respective channels. The respective memory units are preferably formed, for example, with circulating shift registers.

Assuming, for example, that the key codes KC for specifying the respective keys in the keyboard 2 are composed of 2-bit codes $K_2$, $K_1$ representing the types of the keyboards, 3-bit codes $B_3$, $B_2$, $B_1$ indicative of octave tone range, and 4-bit codes $N_4$, $N_3$, $N_2$, $N_1$ expressing the musical notes in one octave, total up ti 9-bit codes and the number of all the channels is 12, the shift registers of 12 stages 9 bits may preferably be employed therefor.

Table I

| Types of Keys | | Key Codes KC | | | | | | | | |
|---|---|---|---|---|---|---|---|---|---|---|
| | | $K_2$ | $K_1$ | $B_3$ | $B_2$ | $B_1$ | $N_4$ | $N_3$ | $N_2$ | $N_1$ |
| Keyboard | Upper | 0 | 1 | | | | | | | |
| | Lower | 1 | 0 | | | | | | | |
| | Pedal | 1 | 1 | | | | | | | |
| Octave tone range | 1st | | | 0 | 0 | 0 | | | | |
| | 2nd | | | 0 | 0 | 1 | | | | |
| | 3rd | | | 0 | 1 | 0 | | | | |
| | 4th | | | 0 | 1 | 1 | | | | |
| | 5th | | | 1 | 0 | 0 | | | | |
| | 6th | | | 1 | 0 | 1 | | | | |
| Musical note | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | A# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

Figure 3:
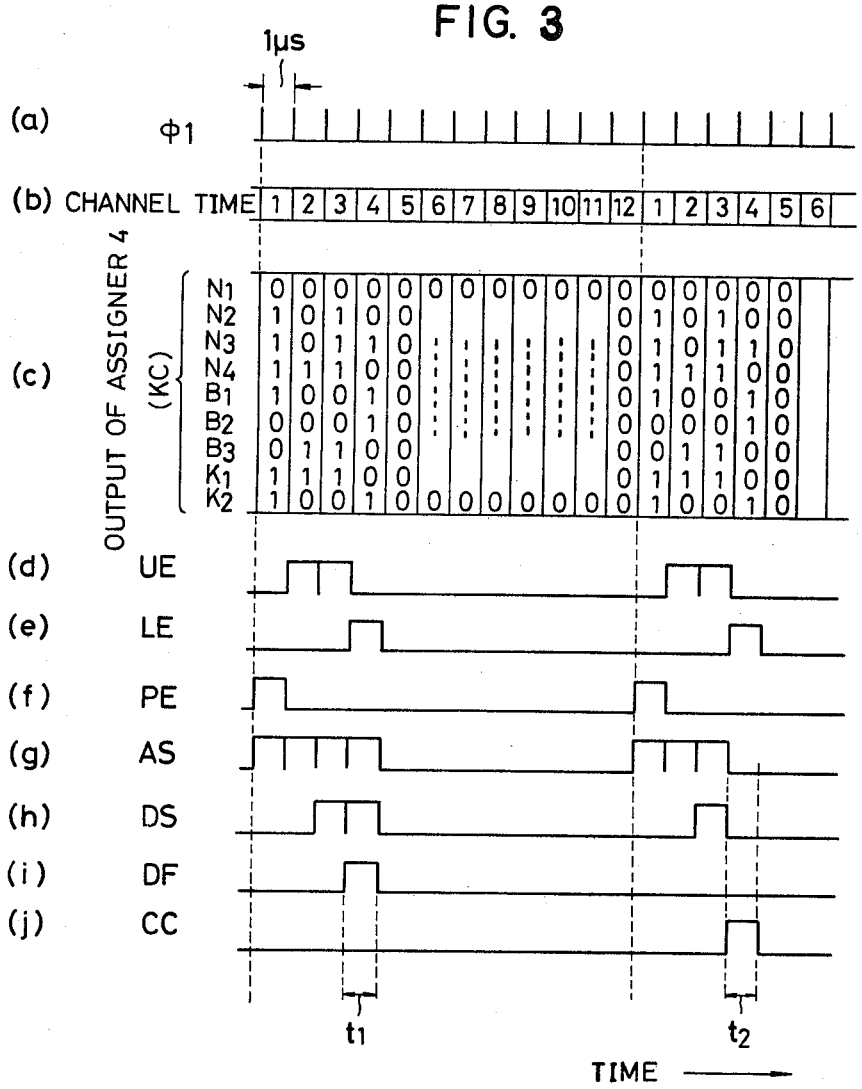
FIGS. 3(*a*) through 3(*j*) are timing chart for the explanatory purpose of the operation of the musical tone assigning circuit adopted in the electronic musical instrument of the invention.

Since this embodiment of the electronic musical instrument is constructed as a dynamic logical circuit system wherein various counters, logics, memories, etc. are commonly used in a time-sharing manner so as to enable the instrument to reproduce a plurality of musical tones simultaneously, the timing relationship of the clock pulses for defining the operation of the instrument is remarkably important. FIG. 3(*a*) graphically denotes master clock pulses $\phi_1$, and these pulses control the time-sharing operation of the respective channels and, for example, have each a pulse period or duration of 1 $\mu$s. One key code KC is consisting of 12 channels, which are successively and sequentially divided distinctly by the master clock pulses $\phi_1$. Each channel thus divided in a pulse length of 1 $\mu$s is hereinafter referred to as "time slot", and the respective time slots correspond successively to first to twelfth channels and are also referred hereinafter correspondingly to first to twelfth channel times, as shown in FIG. 3(*b*). The respective channel times are thus generated in circulation. Therefore, the key codes KC representing the key of the musical tone being played assigned by the musical tone assigning circuit 4 or stored in the aforementioned shift registers are sequentially outputted in correspondence to the channel times thus assigned in a time-sharing manner.

Assume that the note C of the second octave tone range of the pedal keyboard is for example assigned to the first channel, the note G of the fifth octave tone range of the upper keyboard is alloted to the second channel, the note C of the fifth octave tone range of the upper keyboard is assigned to the third channel, and the note E of the fourth octave tone range of the lower keyboard is to the fourth channel, and the musical tones are not alloted to the fifth to twelfth channels, the content of the key codes KC outputted in synchronization with the respective channel times in a time-sharing manner from the musical tone assigning circuit 4 becomes as shown in FIG. 3(*c*). The outputs of fifth to twelfth channels are all "0".

As the pedal keyboard is actuated by one foot of the player in the electronic musical instrument thus formed, only one note can be played at a time. In order to eliminate such single musical tone or note operation by one foot, the key assigner 4 has adopted "a pedal monophonic system" which specifically assigns the notes of the pedal keyboard to a specific channel such as, for example, to first channel in advance. This pedal single musical tone system serves the functions of discriminating the keyboard based on the signal such as key code KC for identifying the key depressed and detected by the depressed key detecting circuit 3 to store the key code KC of the key thus depressed in the memory unit of the first channel specialized for the pedal keyboard in the musical tone assigning circuit 4 when the key code KC is obtained from the pedal keyboard. Consequently, the musical notes of the upper or lower keyboard are alloted in the range from second to twelfth channels.

The musical tone assigning circuit 4 produces an attack start signal or key-on signal AS representing that the musical note should be played for the depressed key in the channel assigned therewith, in synchronization with the respective channel times in a time-sharing manner. The musical tone assigner 4 further produces a decay start signal or key-off signal DS indicating that the key thus depressed and alloted to the respective channels is released thereby falling the musical note corresponding thereto, in synchronization with the respective channel times in a time-sharing manner. These attack and decay start signals AS and DS are utilized for the control of the amplitude envelope of the musical tone or of the musical note.

In addition, the musical tone assigning circuit 4 outputs a clear signal CC for completely resuming the assignment of the musical note by clearing various memories relative to the corresponding channels based on a decay finish signal DF received thereby from an envelope generating circuit 1, which will be hereinafter described in greater detail, representing that the musical note or decay is finished in the channels. Furthermore, the musical tone assigner 4 also produces keyboard signals UE, LE, PE representing the relationship of the corresponding key codes KC to the key of the keyboard, in synchronization with the outputting of the key codes KC. In this connection, the aforesaid relationship of the corresponding key codes KC to the key of the keyboard can be acquainted with the content of the bits $K_2$, $K_1$ indicating the keyboard of the key codes KC. In case of the output from the musical tone assigner 4 as shown in FIG. 3(*c*), for example, the pedal keyboard signal PE is generated at the first channel time as shown in FIG. 3(*f*), the upper keyboard signal UE is produced at the second and third channel times as shown in FIG. 3(*d*), and the lower keyboard signal LE is generated at the fourth channel time as shown in FIG. 3(*e*). In case the output from the musical tone assignment circuit 4 as illustrated in FIG. 3(*c*), assuming that the keys alloted to the first and second channels remain at present depressed, the keys assigned to the third and fourth channels are released with the musical tones being in the falling state, the production of the musical tones are finished in the timing of time slot $t_1$ of the fourth channel thereby producing the decay finish signal DF from the musical tone assigning circuit 4, and the clear signal CC is outputted from the musical tone assigner 4 in the timing of time slot $t_2$ upon delaying of 12 channels therefrom, the attack start signal AS, the decay start signal DS, the decay finish signal DF and the clear signal CC are outputted from the musical tone assignment circuit 4 as indicated in FIGS. 3(*g*) through 3(*j*), respectively. In this case, inasmuch as the clear signal CC is outputted at the timing of time slot $t_2$ from the musical tone assigning circuit 4, the attack start signal AS and the decay start signal DS of the fourth channel are erased. At this time, the key code KC of the fourth channel time shown in FIG. 3(*c*) and the lower keyboard signal LE denoted in FIG. 3(*e*) are also erased, but these signals are still depicted therein for the convenience of explanation.

In this way, the allocation of the respective signals KC, AS, DS, CC, UE to PE fed out of the musical tone assigning circuit 4 to the channels is distinctly determined in accordance with the channel times.

The detailed circuit arrangements of the aforementioned musical tone assigning circuit 4 and the depressed key detecting circuit 3 will not be described hereinafter any further since they may adopt the conventional one as already disclosed known by those skilled in the art. The detail of the pedal monophonic system will not be described hereinafter any further by the same reason as described above. They may, of course, employ other circuit arrangements than described previously.

It will be understood from the foregoing description that since the key codes KC delivered from the musical tone assigning circuit 4 represent the keys depressed, they may be used as an addressing signal for allowing to read out numerical information intrinsic for musical tone frequencies of the keys corresponding to the key codes KC from a frequency information memory 5.

The frequency information memory 51 is composed, for example, or a read only memory for storing frequency informations F (constant) corresponding to the key codes KC of the respective keys in advance and serves the functions of reading out the frequency information F stored in the addresses specified by the key codes KC upon receipt of the key codes KC.

Although the aforementioned frequency information memory 5 is composed of the read only memory, it should also be understood by those skilled in the art that it may be made by other than the read only memory without departing from the spirit of the present invention.

A frequency information accumulator 6 regularly makes cumulative addition of frequency information F sequentially to sample the amplitude of the musical tone waveshape in every constant time, and the frequency information F is digital numerals proportional to the musical tone frequency of the keys such as 15-bit binary numerical signal. This frequency information F is a numeral including the value of a fraction portion as expressed by a radix point notation and consists of the most significant bit of the 15th bit corresponding to an integer portion and the rest 14 bits thereof representing a fraction portion.

The value of the frequency information F can be unitarily determined under a predetermined sampling speed if the value of the musical tone frequency is once specified. For example, assuming that when the value qF, where q represents 1, 2, 3, . . . ., sequentially accumulated with the frequency information F by the frequency information accumulator 6 becomes 64 in a decimal notation, the sampling of one musical tone waveshape is completed and that the cumulative addition of the frequency information F is made in every 12 μs circulating the entire channel time in one cycle, $$F = 12 \times 64 \times f \times 10^{-6}$$

Thus, the value of the frequency information F is determined by this equation. The value "*f*" signifies the frequency of the musical tone. In this manner, this value of the frequency information F may preferably be stored in the frequency counter 6 responsive to the frequency f to be obtained. For example, the musical tone frequency corresponding to the note $C_2$ is 65.106Hz. From this the value of the frequency information F is 0.052325. The values of the information F can also be obtained in the same manner.

The frequency information accumulator 6 makes cumulative addition of the frequency informations F of the respective channels at a predetermined constant sampling speed (at a speed of 12 μs per every channel time) thereby obtaining the accumulated value qF resulting in advansing the phase of the musical tone waveshape to be read out in every sampling time of 12 μs. When the accumulated value qF reaches 64 in a decimal notation, it overflows the counter and resumes to "0" and thus completes the reading of one waveform. Since 64 expressed in a decimal notation can be indicated by 6-bit binary signal, in order to make cumulative addition of the frequency information F shose 1st order integer digit is at fifteenth bit and to store the counting result until the accumulated value qF becomes 64, the counter should have a word length of 20 bits where the first through the fourteenth bits represent the fraction portion and the fifteenth through twentieth bits represent the integer portion. It should be preferred that the frequency information accumulator 6 is consisting of 20-bit adder and a shift register of 12 stages/20 bits so as to commonly use the adder for the respective channels in a time-sharing manner.

A musical tone waveshape memory 7 divides the musical tone waveshape at plural sampling points such as 64 thereby storing the values of amplitudes sequentially at the respective sampling points at the respective addresses. The values qF as the outputs of the frequency information accumulator 6 become the input specifying the addresses to be read out from the musical tone waveshape memory 7. The number of addresses of the musical tone waveshape memory 7 is 64, and the data of the fifteenth through twentieth bits corresponding to the integer portion of the values qF is adapted to be applied to the musical tone waveshape memory 7 as address inputs. The data of the first through fourteenth bits corresponding to the fraction portion of the values qF are merely used in the frequency information accumulator 6 for the purpose of cumulative addition.

As the accumulated values qF are increased in the frequency information accumulator 6, the addresses for specifying the amplitudes of the sampled waveshape to be read are successively and sequentially delivered for successively reading out the amplitudes of the sampled musical tone waveshape from the memory 7.

The amplitude envelope for the musical tone waveshape thus formed as aforementioned is so controlled as to read out the envelope waveshape stored in an envelope memory 8 under the control of the output of an envelope counter 9. If the attack start signal AS or decay start signal DS is supplied from the musical tone assigning circuit 4 to the envelope counter 9, attack clock pulses ACP or decay clock pulses DCP are counted by the envelope counter 9 thereby delivering the addresses for reading out the envelope memory 8.

In the arrangement of an envelope generating circuit 1, the envelope counter 9 has an adder 10 of 6-bit and a 12 stage/6-bit shift register 11 and successively shifts the shift register 11 with the master clock pulses $\phi_1$, the result of addition in the adder 10 being returned to the adder 10 after 12 channel times thereby adding it to the clock pulses supplied from an OR circuit 12. Accordingly, the envelope counter 9 serves the function of cumulatively counting the clock pulses supplied from the OR circuit 12 separately in each channel in a time-sharing manner. The counted output of the envelope counter 9 is applied to the envelope memory 8 for reading out the amplitude of the envelope waveshape stored at the addresses expressed by the counted values. The envelope memory 8 divides the waveshape of the attack portion A shown in FIG. 1(*a*) into 17 sample points and stores the attack waveform at addresses starting from 0 to a predetermined address, e.g. 16. The envelope memory 8 also divides the waveshape of the decay portion D into 47 sample points and stores the decay waveform at addresses from the next address 17 to the last address, e.g. 63.

A clock pulse generating unit or generator 13 generates attack clock pulses ACP and decay clock pulses DCP in a manner for providing the frequencies of the pulses ACP and DCP depending upon the types of the keyboards thereby enabling the attack and decay clock pulses ACP and DCP of predetermined frequencies to be outputted in response to the keyboard signals UE, LE, PE. It should also be possible to construct in such a manner that the frequencies of the respective clock pulses ACP and DCP may be varied freely as desired in the same manner as was described with regard to the types of the keyboards.

Figure 4:
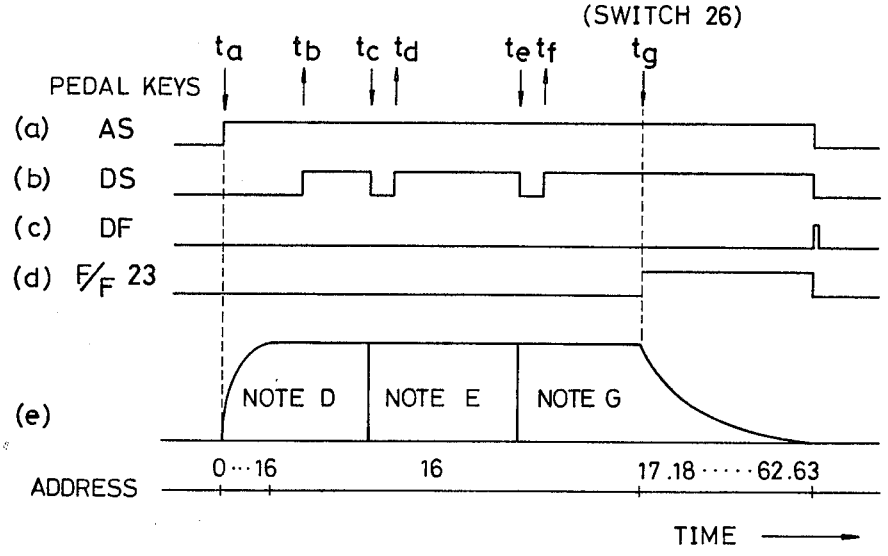
FIG. 4(*a*) through 4(*e*) are timing chart of the wave shape at various points of the electronic musical instrument circuit effective to provide a legato performance with the pedal keyboard for describing the operation thereof.

Description will now be made about the counting operation of the envelope counter 9 with respect to the first channel alloted with the note of the pedal keyboard. FIG. 4 shows the timing chart representation of the first channel time extracted.

When the key of note D is depressed in the pedal keyboard at a time $t_a$, the musical tone assigning circuit 4 produces the attack start signal AS as shown in FIG. 4(*a*) at the first channel time. The attack start signal AS thus produced is applied to an AND circuit 14 as shown in FIG. 2 thereby enabling the AND circuit 14 to become operative. Since the output of the envelope counter 9 is "0" at this time, the AND circuit 14 has already received signals "1" obtained by inverting outputs "0" of an AND circuit 15 and an OR circuit 16, respectively with inverters 17 and 18, and gates out the attack clock pulses ACP through the AND circuit 14 and the OR circuit 12 to the adder 10 thereby starting to count the attack clock pulses ACP in the envelope counter 9. When the counted value has reached 16, an output "1" is produced from the fifth bit of the shift register 11 and, accordingly, the output of the OR circuit 16 becomes "1". As a result, the attack clock pulses ACP remains prevented from passing the AND circuit 14 with respect to the subsequent counts. Even if the counted value exceeds 15 by the envelope counter 9, the same operation as was described with respect to the attack clock pulses ACP continues. Accordingly, counting is once stopped and the amplitude stored at address 16 of the envelope memory 8 continues to be read out. Thus, a sustain state is maintained at a constant predetermined level after the reading of the waveshape of the attack portion A as shown in FIG. 4(*e*).

In this sustain state, an AND circuit 19 receives a signal "1" from the OR circuit 16 and also a signal "1" which is obtained by inverting the output "0" of the AND circuit 15 by the inverter 17. Therefore, when the decay start signal DS becomes "1", this causes the AND circuit 19 to pass the decay clock pulses DCP supplied through an AND circuit 20 to the adder 10. However, in case where a legato effect is provided for the pedal keyboard note, the AND circuit 20 becomes inoperative thereby preventing the decay clock pulses DCP from passing to the AND circuit 19.

More specifically, in case the pedal legato effect is provided in the above example, a switch 21 is closed so that the signal level at a line 25 becomes "0" thereby applying the signal "0" to an OR circuit 22. On the other hand, a flip-flop 23 is normally reset, and the other input of the OR circuit 22 is thus "0" from the reset flip-flop 23. Consequently, the output of the OR circuit 22' also become "0". In this way, the output of an OR circuit 24 becomes "0" at the channel times of the pedal keyboard thereby causing the AND circuit 20 to be inoperative.

In this state, the upper and lower keyboard signals UE and LE are adapted to be applied to the OR circuit 24 so that the AND circuit 20 becomes operative with respect to the note of the upper or lower keyboard with the result that the decay clock pulses DCP are applied to the adder 10 thereby prohibiting the legato effect.

When the key of the note D is released at a time $t_b$ in the state that the pedal legato switch 21 is thrown on to cause the line 25 to be "0", the decay start signal DS becomes "1" as illustrated in FIG. 4(*b*). However, as the decay clock pulse DCP is prevented from passing by the AND circuit 20, the envelope counter 9 maintains the counted value 16. Accordingly, a predetermined constant sustain level is continued for reading out from the envelope memory 8 as shown in FIG. 4(*e*) resulting in continuing the note D.

When the key of the note E is depressed in the pedal keyboard at a time $t_c$, the key of the note D alloted to the first channel specified for the pedal keyboard is forcibly prohibited from the assignment regardless of the musical note being kept playing in the musical note assigning circuit 4 adopting the pedal monophonic system, and the key of the note E newly depressed is assigned to the first channel. Therefore, the key codes KC stored in the memory for the first channel is written from the note D to E at the time to for reading out the musical tone waveshape of the frequency of the note E from the musical tone waveshape memory 7. The decay start signal DS of the first channel is forcibly reset to "0" simultaneously with the aforementioned operation. The attack start signal AS is formally reset with respect to the note D, but the attack start signal AS relative to the note E is generated in this way so that the attack start signal AS is actually continuously generated at the first channel time. Since the counted outputs of the shift register 11 are 16, the AND circuit 14 cannot operate. Accordingly, a predetermined constant sustain level can still be read out from the envelope memory 8. As is noted in FIG. 4(*e*), inasmuch as the amplitude envelope is constant and only the pitch of the musical note is varied from the note D to E, the aforesaid legato effect can be thus obtained.

Even if the key of the note E is released at a time $t_d$, the amplitude envelope still maintains the sustain level in the same manner as aforementioned, and when the key of the note G is depressed in the pedal keyboard at a time $t_e$, the legato effect can be carried out in the same manner as previously described. Even though the key of the note G is released at a time $t_f$ and the decay start signal DS becomes "1", the sustain level is still maintained.

When the pedal legato switch 21 is actuated to off, positive voltage $+Vcc$ is present at the line 25 to cause the input of the OR circuit 22 to become "1", thereby finishing the legato effect.

In order to simply finish the legato effect during the performance of the upper or lower keyboard with both hands, there is provided a normally open switch 26 of self-restoring type from the voltage source $+Vcc$ line to the set input of the flip-flop 23. It is preferred that the actuator of this switch 26 be provided at the location capable of operating with one foot of the player for the electronic musical instrument. For example, the actuator or operation pedal of the switch 26 may preferably be provided in the vicinity of the toe situation of an expression pedal known as the control of the sound volume of the musical note by the actuation of the pedal.

The description will now be made about the operation of this normally open switch 26 with reference to the arrangement illustrated in FIG. 2. When the legato finish switch 26 is closed at the time $t_g$, the positive voltage $+Vcc$ is applied to a resistor 27 thereby applying the signal "1" to the set input of the flip-flop 23. The flip-flop 23 is thus set thereby producing "1" of the output Q as designated in FIG. 4(*d*). The "1" output from the flip-flop 23 thus obtained is then applied through the OR circuits 22 and 24 to the AND circuit 20 thereby causing the AND circuit 20 to be operative. Since the decay start signal DS representing the release of the key of the note G, the output of the OR circuit 16 and the output of the inverter 17 are all "1" at this time, the decay clock pulses DCP are applied through the AND circuits 20 and 19 and then the OR circuit 12 to the adder 10. Thus, the envelope counter 9 starts to count the clock pulses DCP so that as the counted value becomes increased as 17, 18 . . . , the amplitude envelope of the decay portion D stored in the addresses 17, 18, . . . of the envelope memory 8 are read out.

If the counted value of the envelope counter 9 becomes a maximum of 63, the amplitude of the final address is read out from the envelope memory 8, thereby finishing the reading out of the envelope waveshape of the decay portion D. As the entire bit of the counted output of the register 11 become "1" at this time, the AND circuit 15 gates out "1". This output "1" of the AND circuit 15 is utilized for the signal DF for finishing the decay as shown in FIG. 4(*c*).

The musical tone assigning circuit 4 receives the decay finish signal DF from the AND circuit 15 thereby generating the clear signal CC. Then, this decay finish signal DF thus obtained from the AND circuit 15 is applied to the reset input of the flip-flop 23 to reset it. The clear signal CC is inverted by an inverter 28 to "0" to cause AND gate group 29 provided between the adder 10 and the register 11 to be inoperative. Therefore, the output of the adder 10 is prevented thereby clearing the stored counted value of the register 11 with respect to the first channel to "0". Further, the clear signal CC also clears the key codes KC expressing the note G, attack start signal AS, and decay start signal DS generated at the first channel time to "0".

It will be understood from the foregoing description that the legato effect can be finished by setting the flip-flop 23 with the normally opend switch 26 of self-storing type. In this way, the circuit arrangement of the electronic musical instrument may resume the legato operation again by resetting the flip-flop 23 upon completion of the musical tone or note or of the decay. Inasmuch as the signal at the line 25 is "0" as long as the pedal legato switch 21 remains on, the clock pulse DCP may pass through the AND circuit 20 during the set period of the flip-flop 23, but if the latter is reset, the clock pulse DCP is prevented from passing at the AND circuit 20. Therefore, the legato can also be employed for the note selected by the pedal keyboard after completion of the musical note G in FIG. 4(*e*).

The amplitudes of the envelope waveshapes read out from the envelope memory 8 can be applied to the musical tone waveshape memory 7 thereby controlling the amplitude of the musical tone waveshape read out from the musical tone waveshape memory 7.

The musical tone waveshape memory 7 and the envelope memory 8 may operate to read out the amplitudes of the sampled waveform of analog voltage in response to the digital address input so as to form analog musical tone waveshape amplitudes from analog envelope amplitudes outputted from the envelope memory 8 as the power supply voltage of the musical tone waveshape memory 7 as will be understood by those skilled in the art. Accordingly, the amplitudes of the musical tone waveshapes read out from the musical tone waveshape memory 7 are varied and controlled in response to the amplitudes of the envelope waveshapes. The musical tone waveshape signal thus envelope-controlled is applied to a tone-color and volume control circuit 30 for controlling the tone-color and volume of the musical tone, and output of the tone-color and volume control circuit 30 thus controlled is then applied to an audio system 31 for reproducing the musical tones.

In the above-described embodiment, in case where read-only memories are employed in the envelope memory 8 or the musical tone waveshape memory 7, it is preferred to provide a multiplying circuit (not shown) separately in the aforementioned circuit arrangement of the electronic musical instrument for multiplying the musical tone waveshape by the envelope amplitude, and the output of the multiplying circuit thus operated in thereafter converted into an analog signal before applying to the audio system 31 for reproducing the musical tones.

It will be noted from the foregoing description that according to the circuit arrangement of the electronic musical instrument of the present invention, the legato performance can be played by the pedal keyboard only with the pedal legato switch 21 being thrown on. It will further be appreciated that the legato effect can also be simply finished as required merely by actuating the switch 26 with a foot of the player so as to increase the performance effect by the simple operations.

Although the invention has been described and illustrated in detail, it is to be understood clearly that the same is by way of illustration and example only and is not to be taken by way of limitation, the spirit and scope of this invention being limited only by the terms of the appended claims.

What is claimed is:

1. In an electronic musical instrument of a type having a memory storing the amplitude envelope of a musical tone, a first circuit for designating an address used for reading the amplitude envelope from said memory and a second circuit for supplying clock pulses to said first circuit in response to depression or release of the key thereby to shift the address, said electronic musical instrument comprising means for selectively preventing subsequent supply of said clock pulses to said first circuit regardless of depression or release of the key when the address designated by said first circuit has shifted to a predetermined step thereby to maintain the reading address at said predetermined step.

2. An electronic musical instrument according to claim 1 wherein said second circuit includes;

a clock pulse generator producing a train of clock pulses to said first circuit, first gate means for gating said clock pulses to said first circuit in response to key release to cause readout from said memory of the portion of said amplitude envelope establishing a decay of said musical tone, and wherein said means for selectively preventing comprises;

a switch for selecting normal or legato operation of said musical instrument, and second gate means, actuated when said switch is set to select legato operation and cooperating with said first gate means, for inhibiting the supply of said clock pulses even when said key is released, thereby preventing decay and causing continued tone production of said musical tone without change in envelope amplitude.

3. In a keyboard electronic musical instrument having a tone generator and an envelope memory storing a set of amplitude scale factors which are utilized by said tone generator to establish the amplitude envelope of the tone generated thereby, the improvement for producing a legato effect comprising:

a clock pulse source, address means for addressing successive locations of said envelope memory in response to pulses from said clock source, thereby to read out said amplitude scale factors for utilization by said tone generator, first gate means, response to depression of a selected keyboard key, for gating pulses from said clock to said address means so as to read out from said envelope memory a subset of scale factors establishing the attack portion of an amplitude envelope, second gate means cooperating with said address means and with said first gate means for inhibiting said address means from responding to additional pulses from said clock source once said address means has accessed the envelope memory storage location storing the final amplitude scale factor for said attack portion, so that said tone generator continues to produce said tone at a sustained level, third gate means, responsive to release of said selected keyboard key, for gating additional pulses from said clock source to said address means, thereby to read out from said envelope memory a subset of scale factors establishing the decay portion of said amplitude envelope, and legato switch means for selecting normal or legato operation of said musical instrument, said switch means, when set to select legato operation, inhibiting said third gate means from gating additional pulses to said address means even when said selected keyboard key is released, so that tone production continues with unchanged envelope amplitude.

4. An electronic musical instrument according to claim 3 having means for causing said same tone generator to generate another tone in response to depression of a subsequent keyboard key after release of said selected keyboard key so that, when said switch means is set for legato operation; said tone production of the former tone continues with unchanged envelope amplitude until said subsequent keyboard key is depressed, whereupon the new tone begins with the same unchanged envelope amplitude.

5. An electronic musical instrument according to claim 3 further comprising;

legato termination switch means to be actuated when the legato effect is to be terminated, actuation of said termination switch means enabling said third gate means to gate additional pulses to said address means when said keyboard key is released so that the decay portion of said amplitude envelope is established.

6. In an electronic musical instrument having a tone generator for producing selected tones, the envelope amplitude of said tones being established by amplitude scale factors read from a memory, a system for producing a legato effect comprising:

first means for establishing the normal attack and decay envelope of a generated tone by initial readout of attack scale factors from said envelope means in response to key depression and subsequent readout of decay scale factors from said envelope memory in response to key release, and second means for inhibiting readout of said decay scale factors when a legato effect is selected, so that production of a first selected tone is continued at a sustained constant amplitude level after key release until a subsequent tone is selected, that subsequent tone then being produced without attack and at the same constant amplitude level.

* * * * *